United States Patent [19]

White et al.

[11] Patent Number: 4,988,318

[45] Date of Patent: Jan. 29, 1991

[54] UNSATURATED VAPOR HIGH PRESSURE SODIUM LAMP ARC TUBE FABRICATION PROCESS

[75] Inventors: Philip J. White, Georgetown; John A. Scholz, Danvers; Robert S. White, Beverly, all of Mass.

[73] Assignee: GTE Products Corporation, Danvers, Mass.

[21] Appl. No.: 294,954

[22] Filed: Jan. 6, 1989

Related U.S. Application Data

[63] Continuation of Ser. No. 807,120, Dec. 11, 1985, abandoned, which is a continuation of Ser. No. 689,028, Jan. 7, 1985, abandoned, which is a continuation of Ser. No. 473,894, Mar. 10, 1983, abandoned.

[51] Int. Cl.[5] ..... H01J 9/00
[52] U.S. Cl. ..... 445/26
[58] Field of Search ..... 445/26, 31, 55

[56] References Cited

U.S. PATENT DOCUMENTS

| | | | |
|---|---|---|---|
| 3,385,644 | 5/1968 | Della Porta | 445/21 |
| 3,578,834 | 5/1971 | Della Porta | 445/21 |
| 3,726,582 | 4/1973 | Tol et al. | 445/26 |
| 4,308,650 | 1/1982 | Hernandez | 445/26 |
| 4,333,032 | 6/1982 | Wyner et al. | 445/41 |
| 4,445,873 | 5/1984 | Tsuzurabara | 445/31 |

FOREIGN PATENT DOCUMENTS

| | | | |
|---|---|---|---|
| 0101874 | 9/1978 | Japan . | |
| 0133732 | 10/1980 | Japan | 445/41 |

*Primary Examiner*—Kurt Rowan
*Attorney, Agent, or Firm*—Thomas H. Buffton; Martha Ann Finnegan

[57] ABSTRACT

An arc tube fabricating process wherein an oxygen-absorbing getter is affixed to at least one of a pair of electrodes, one of the electrodes is sealed into the end of a tubular ceramic envelope, a dosage is deposited in the tubular ceramic envelope and the other one of the pair of electrodes is sealed into the other end of the tubular ceramic envelope.

7 Claims, 3 Drawing Sheets

UNSATURATED VAPOR HIGH PRESSURE SODIUM LAMP ARC TUBE FABRICATION PROCESS

This is a continuation of Ser. No. 807,120 filed 12-11-85, continued from Ser. No. 689,028 filed 1-7-85, continued from Ser. No. 473,894, filed 3-10-83; now all abandoned.

CROSS REFERENCE TO OTHER APPLICATIONS

Concurrently filed applications entitled "Unsaturated Vapor Pressure Type High Pressure Sodium Lamp," now abandoned, U.S. Ser. No. 473,895, and "Unsaturated Vapor High Pressure Sodium Lamp Getter Mounting," now abandoned, U.S. Ser. No. 473,897, relate to an arc tube and an arc tube fabricating process for unsaturated vapor high pressure sodium lamps. Also, concurrently filed applications entitled "Arc Tube Fabrication Process," now abandoned, U S. Ser. No. 473,896, and "Arc Tube Dosing Process For Unsaturated High Pressure Sodium Lamps," now abandoned, U.S. Ser. No. 473,892, relate to arc tube fabrication and arc tube dosing of unsaturated vapor type high pressure, sodium lamps.

TECHNICAL FIELD

This invention relates to high pressure sodium lamps of the unsaturated vapor type and more particularly to a process for fabricating arc tubes for unsaturated vapor high pressure sodium lamps.

BACKGROUND ART

In the field of high pressure sodium lamps, the best known configuration includes a tubular ceramic arc tube disposed within an evacuated glass envelope. The arc tube is filled or dosed with a rare gas and an excessive amount of sodium and mercury. In other words, the arc tube has a saturated sodium fill because of the well known tendency whereby large amounts of sodium are lost during operation of the lamp. Moreover, such saturated type high pressure sodium lamps leave much to be desired due to the undesired variations in color rendition and operational voltages which are encountered.

In order to eliminate or at least reduce the above-mentioned undesirable characteristics, the so-called unsaturated vapor type high pressure sodium lamp was developed. Herein the construction is somewhat similar to the saturated type lamp except that the dosage of sodium, in particular, is greatly reduced. Moreover, it was found that such a reduction in sodium content was possible so long as provision was made for absorbing the excess oxygen which undesirably accompanied the fill or rare gas which was dispensed into the arc tube.

One of the techniques for effecting this absorption of undesired oxygen within the arc tube is to enclose an oxygen-absorbing getter therein along with the usual dosage of sodium, mercury and a rare gas. One such structure is set forth and described in a concurrently filed application U.S. Ser. No. 473,895, assigned to the Assignee of the present application.

As set forth therein, a getter material is located within the arc tube and in contact with the gases therein. Thus, any undesired oxygen within the arc tube occurring during the sodium or mercury vaporization process or accompanying the admitted rare gas is absorbed by the getter material and compound reformation is inhibited.

However, it has been found that even though the above-described technique has provided great improvement over prior known unsaturated vapor high pressure sodium lamp construction and fabrication, there are still areas which leave something to be desired. More specifically, it has been found that direct contact between the enclosed getter material and the hottest portions of the tubular ceramic envelope of the arc tube tend to cause what appears to be a chemical reaction therebetween and an undesired darkened area of the ceramic envelope. Obviously, arc tube darkening is not a desirable condition.

OBJECTS AND SUMMARY OF THE INVENTION

An object of the present invention is to provide an improved unsaturated vapor type high pressure sodium lamp. Another object of the invention is to enhance an unsaturated vapor high pressure sodium lamp by improving the arc tube therein. Still another object of the invention is to provide an improved process for fabricating an arc tube employed in an unsaturated vapor type high pressure sodium lamp. A further object of the invention is to provide a process for fabricating an arc tube for an unsaturated vapor type high pressure sodium lamp wherein undesired envelope discoloration is inhibited.

These and other objects, advantages and capabilities are achieved in one aspect of the invention by a process for fabricating arc tubes for unsaturated vapor type high pressure sodium lamps wherein an oxygen-absorbing getter is affixed to one of a pair of electrodes, a tubular ceramic envelope is dosed with mercury, sodium and a rare gas and the electrodes are each sealed into an end of the tubular ceramic envelope with the getter therein and spaced from the envelope.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
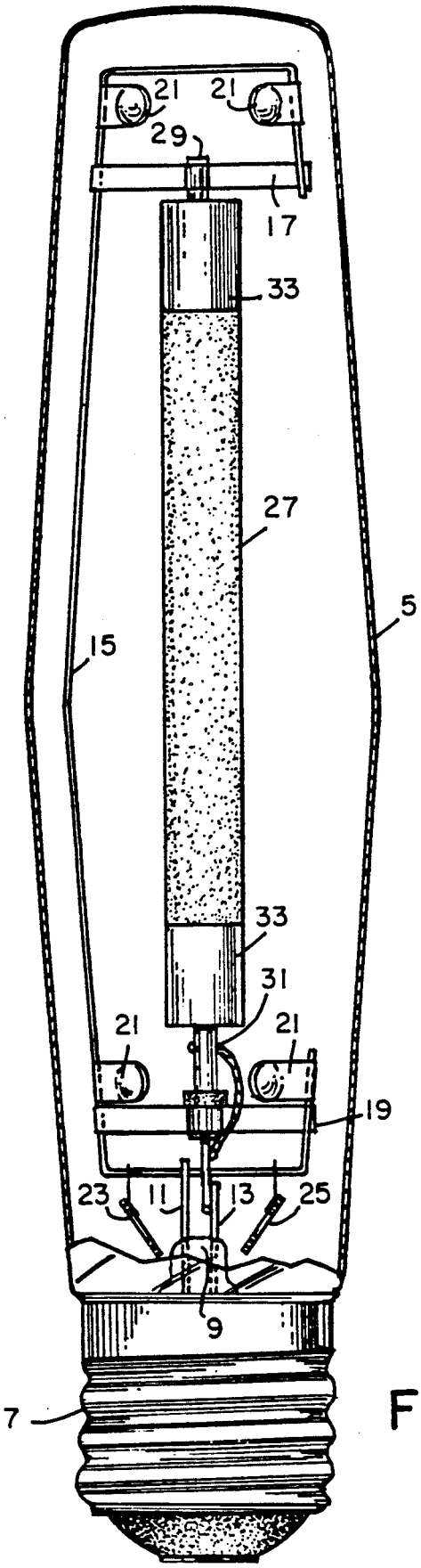
FIG. 1 is an elevational view of a preferred form of unsaturated vapor type high pressure sodium lamp of the invention.

Referring to the drawings, FIG. 1 illustrates an unsaturated vapor high pressure sodium lamp having a hermetically sealed and evacuated glass envelope 5 formed to fit into an ordinary screw-type base member 7. A glass stem member 9 is sealed to the envelope 5 and projects therein. Electrical conductors, 11 and 13 respectively, are sealed into and pass through the stem member 9 to provide electrical connections from the interior to the exterior of the glass envelope 5.

An electrically conductive support member 15 is affixed to one of the electrical conductors 11 and has a pair of crossbars 17 and 19 affixed thereto at either end. Also, a plurality of spring-like members 21 are affixed to the support member 15 and formed for contact with the glass envelope 5. Moreover, a pair of getters 23 and 25 are attached to the support member 15 and serve to insure the integrity of the evacuated envelope 5.

Disposed within the glass envelope 5 and supported by the crossbars 17 and 19 is an arc tube 27. This arc tube 27, preferably of a material such as polycrystalline alumina for example, includes an electrode 29 and 31 at either end thereof. One electrode 29 is affixed to and supported by the crossbar 17 while the other electrode 31 is insulatingly supported by the other crossbar 19, but electrically connected to the electrical conductor 13 passing through the stem member 9. Heat conserving elements 33 may be wrapped about the arc tube 27 at each end thereof in the vicinity of the electrodes 29 and 31 in order to reduce the heat differential thereat from the center of the arc tube 27.

Figure 2:
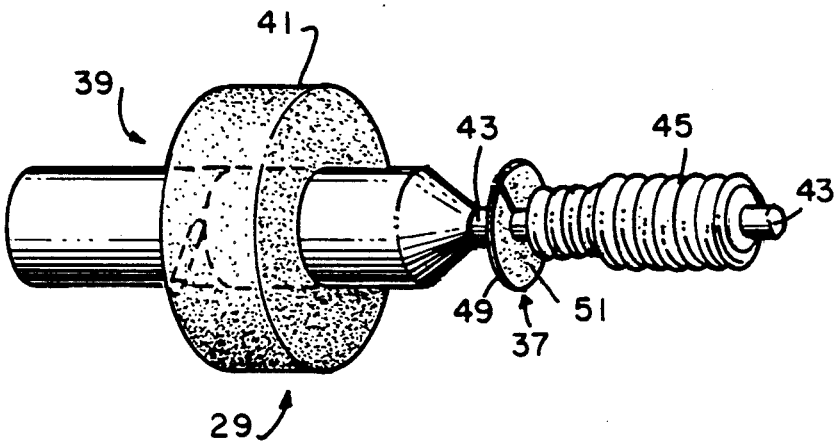
FIG. 2 is an exploded sectional view of an electrode formed for attachment of an oxygen-absorbing getter thereto and placement thereof within an arc tube.

Referring more specifically to FIG. 2 and the placement of an oxygen-absorbing getter 37 therein, it is to be noted that the getter 37 is preferably in the form of a support member or substrate 49 whereon an oxygen-absorbing metal alloy 51 is affixed as by sintering. Preferably, the substrate 49 is of a material such as nickel plated iron and the sintered getter material is an alloy of metals selected from the group consisting of zirconium, aluminum, titanium, scandium, cerium, lanthanum, thorium or yttrium. However, other rare earth oxides are suitable gettering materials for attachment to the substrate 49.

In the process of fabricating the previously-discussed arc tube, 27 of FIG. 1, an oxygen-absorbing gettering material or metal alloy 51 is sintered to a substrate 49 which is preferably in the form of a slitted apertured disc or getter 37. This getter is preferably formed for attachment to the shank portion 43 of the electrode member 39 such as by slipping the slitted apertured disc 37 onto the shank portion 43.

In the arc tube assembly, one of the electrodes 31 is sealed into one end of the ceramic envelope of the arc tube 27. Following, a dosing of sodium, mercury and a rare gas is deposited within the ceramic envelope of the arc tube 27. This dosing includes sodium and mercury in an amount which will become totally vaporized to provide a desired unsaturated vapor type high pressure sodium lamp. Preferably, a sodium-mercury amalgam, which will decompose within the arc tube 27, is deposited therein, and a rare gas is admitted into one end of the arc tube 27.

Thereafter, the other electrode, 29 of FIG. 1, having the oxygen-absorbing getter 37 affixed thereto is sealed into the other end of the arc tube 27. Moreover, this sealing of the electrodes 29 and 31 into the opposite ends of the tubular ceramic envelope of the arc tube 27 is preferably, not necessarily, effected by a frit sealing technique. Therein, a ceramic wafer, 41 of FIG. 2, is affixed to the electrode 39 and a glass frit material, not shown but preferably in the form of a wafer with a central hole, is utilized to effect the desired frit sealing of the electrodes 29 and 31 into the ends of the arc tube 27 in a manner such that the cathode portion 45 and the getter 37 are within the arc tube 27.

Figure 3:
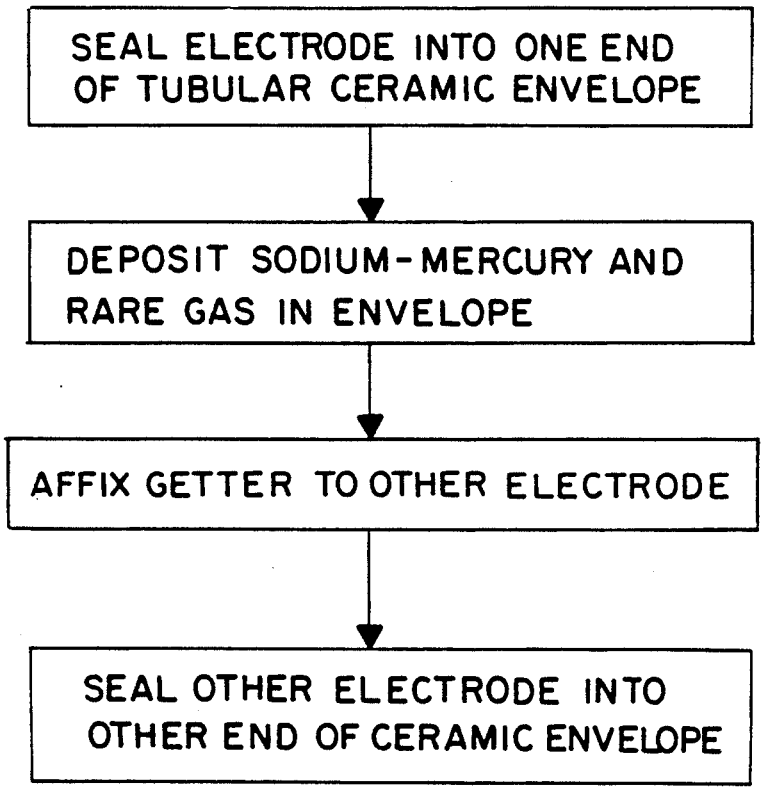
FIG. 3 is a flow chart illustrating the process steps of fabricating an embodiment of an arc tube of the high pressure sodium lamp of FIG. 1.

Referring to the flow chart of FIG. 3, it can be seen that the arc tube fabrication process is readily effected by sealing an electrode into one end of a tubular ceramic envelope of the arc tube. Then a dose of sodium, mercury and rare gas is deposited into the envelope in an amount sufficient for vaporization and provision of an unsaturated vapor type high pressure sodium lamp. Thereafter the other end of the tubular ceramic envelope is sealed with an electrode to which is affixed an oxygen gettering material to provide the desired arc tube.

Thus, a process has been provided for fabricating an arc tube for an unsaturated vapor type high pressure sodium lamp. Although one technique for affixing the getter within and spaced from the envelope has been provided, it is obvious that other methods of attachment could be used. For example, the getter could be welded to the cathode shank or dispensed or affixed to the cathode portion 45 of the electrode. In any event, the getter is spaced from the ceramic envelope of the arc tube.

While there has been shown and described what is at present considered the preferred embodiments of the invention, it will be obvious to those skilled in the art that various changes and modifications may be made therein without departing from the invention as defined by the appended claims.

What is claimed is:

1. In a process for fabricating an unsaturated vapor type high pressure sodium lamp, an arc tube fabricating process comprising the steps of:

forming an oxygen-absorbing getter by sintering a metal to an apertured disc support, splitting said disc support and attaching said split disc support to at least one electrode of a pair of electrodes with said electrode passing through said apertured disc;

sealing one electrode of said pair of electrodes into one end of a tubular ceramic envelope;

depositing a dosing of mercury, sodium and rare gas within said envelope, said sodium and mercury each being deposited in an amount such that said sodium and mercury will be totally vaporized to provide an unsaturated vapor type high pressure sodium lamp; and sealing the other electrode of said pair of electrodes having a getter affixed thereto into the other end of said tubular ceramic envelope with said getter disposed within and spaced from said ceramic envelope to form an arc tube for an unsaturated vapor type high pressure sodium lamp.

2. The arc tube fabricating process of claim 1 wherein said depositing of said dosing within said envelope includes the depositing of a sodium-mercury amalgam therein.

3. The process of claim 1 wherein said getter is in the form of a metal alloy selected from the group consisting of aluminum, zirconium, titanium, scandium, hafnium, cerium, lanthanum, thorium and yttrium.

4. In a process for fabricating an unsaturated vapor type high pressure sodium lamp, an arc tube fabricating process comprising the steps of:

affixing an oxygen-absorbing getter to at least one electrode of a pair of electrodes wherein said oxygen-absorbing getter is in the form of a zirconium-aluminum alloy sintered to an apertured split nickel plated iron substrate and said getter is affixed to the electrode by means of said apertured split substrate;

sealing one electrode of said pair of electrodes into one end of a tubular ceramic envelope;

depositing a dosing of mercury, sodium and rare gas within said envelope, said sodium and mercury each being deposited in an amount such that said sodium and mercury will be totally vaporized to provide an unsaturated vapor type high pressure sodium lamp; and sealing the other electrode of said pair of electrodes having a getter affixed thereto into the other end of said tubular ceramic envelope with said getter disposed within and spaced from said ceramic envelope to form an arc tube for an unsaturated vapor type high pressure sodium lamp.

5. An arc tube fabricating process for unsaturated vapor type high pressure sodium lamps comprising the steps of:

sealing a first electrode into one end of a tubular ceramic envelope;

dosing said tubular ceramic envelope with a sodium-mercury amalgam and a rare gas, said sodium-mercury amalgam being added in an amount such that the sodium and mercury will be totally vaporized to provide an unsaturated vapor type high pressure sodium lamp;

attaching an oxygen-absorbing getter to a second electrode, said oxygen-absorbing getter being in the form of an apertured split supporting disc with an oxygen-absorbing material sintered thereto; and sealing said second electrode having an attached getter into the other end of said tubular ceramic envelope with said getter disposed within and spaced from said ceramic envelope to provide an arc tube for an unsaturated vapor type high pressure sodium lamp.

6. The arc tube fabricating process of claim 5 wherein said step of attaching said oxygen-absorbing getter to said second electrode includes the step of spacing said getter from said tubular ceramic envelope.

7. The arc tube fabricating process of claim 5 wherein said oxygen-absorbing material is a metal alloy selected from the group consisting of zirconium, aluminum, titanium, scandium, hafnium, cerium, lanthanum, thorium and yttrium.

* * * * *